US005720331A

United States Patent [19]

Antonetti

[11] Patent Number: 5,720,331

[45] Date of Patent: Feb. 24, 1998

[54] VERTICAL MULTIPLE-SLAT BLIND

[76] Inventor: Oscar Anselmo Antonetti, Presidente Derqui 864, 1824 - Lanus Oeste - Buenos Aires, Argentina

[21] Appl. No.: 677,566

[22] Filed: Jul. 8, 1996

[30] Foreign Application Priority Data

Jul. 7, 1995 [AR] Argentina ..... 332684

[51] Int. Cl.[6] ..... E06B 9/36

[52] U.S. Cl. ..... 160/168.1 V; 160/900

[58] Field of Search ..... 160/168.1 V, 176.1 V, 160/177 V, 172 V, 900, 352, 345, 178.1 V

[56] References Cited

U.S. PATENT DOCUMENTS

| | | | |
|---|---|---|---|
| 2,422,407 | 6/1947 | Green | 160/172 V |
| 2,604,159 | 7/1952 | Wright | 160/172 V |
| 3,106,240 | 10/1963 | Weber | 160/168.1 V |
| 4,102,381 | 7/1978 | Bratschi | 160/172 V X |
| 4,114,673 | 9/1978 | Wit et al. | 160/173 V X |
| 4,116,257 | 9/1978 | Bratschi | 160/168.1 V |
| 4,594,742 | 6/1986 | Zeigler et al. | 160/345 X |
| 4,653,564 | 3/1987 | Marocco | 160/177 V X |
| 4,830,081 | 5/1989 | Morris | 160/178.1 V X |

FOREIGN PATENT DOCUMENTS 246418 8/1994 Argentina .

*Primary Examiner*—David M. Purol
*Attorney, Agent, or Firm*—Darby & Darby

[57] ABSTRACT

A vertical multiple slat blind having an elongated headrail with a central slot. There are a plurality of vertical slats with a cross-member extending across the width of one end of the slat and a plurality of hook member having a head end riding in the headrail slot and a hook end connected to the slat one end. A first cord and a second cord are connected to one end of the cross-members of the plurality of slats for rotating them in a first or a second direction as one of the cords is pulled. The headrail has a curved portion such that the cord corresponding to the larger radius of curvature of the headrail has a greater travel distance upon rotation of the slats and effects closure.

9 Claims, 2 Drawing Sheets

FIG.5
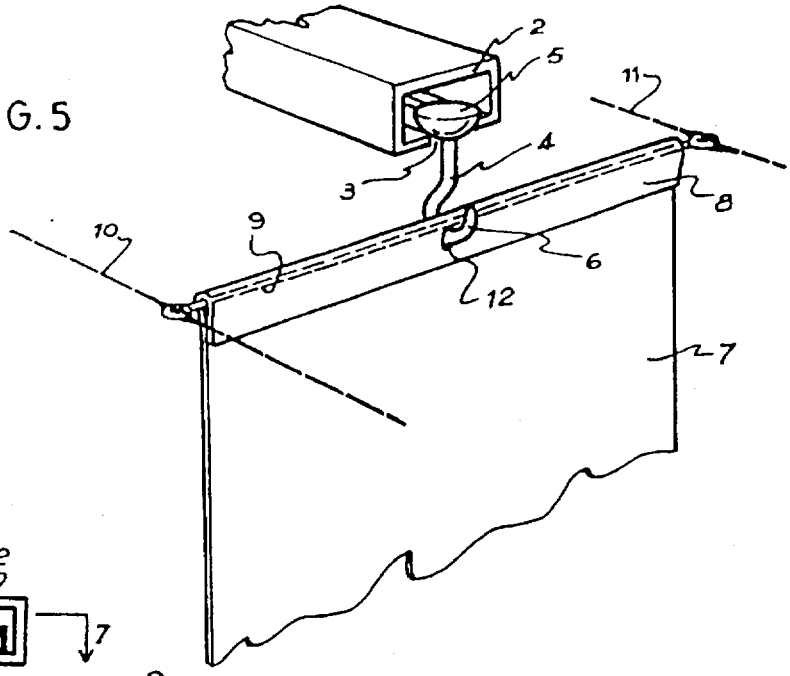
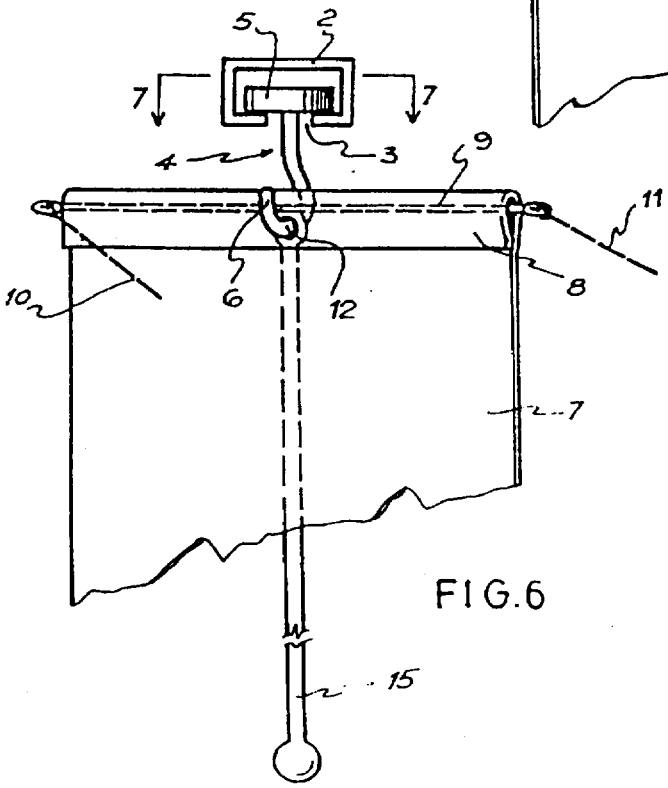
FIG.6
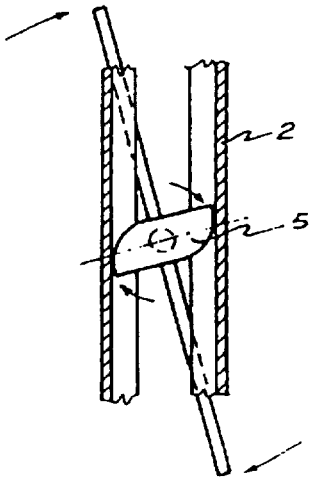
FIG.7

VERTICAL MULTIPLE-SLAT BLIND

FIELD OF THE INVENTION

The present invention relates to a curtain composed of sliding and revolving vertical slats and more specifically to a curtain composed of sliding and revolving vertical slats with an enhanced closure.

BACKGROUND OF THE INVENTION

There exist several kinds of blinds with various types of support or installation devices. However, the final closure of such blind is not always effective.

One possible solution to this problem is described in the invention, patent No. 246,418 in Argentina, in which a good closure is achieved by a multi-section parallelogram formed by two elongated horizontal bars, external to the outside ends of the slats. The ends of the bars are linked to the outside borders of the first slat, and to an auxiliary hook placed on the outside of the last slat. Therefore, when the parallelogram is flattened, its longer sides force the individual slats to close.

However, it is very difficult to conceal the existence of these elongated bars.

A solution has now been devised, which allows for the perfect closing of a blind made of sliding and revolving vertical slats suspended from a headrail or a similar bar.

BRIEF DESCRIPTION OF THE INVENTION

For this purpose, at least part of the headrail is slightly curved so that the exterior side is slightly longer than the interior side of the curve. As a result, the blind, through its conventional horizontal ladder formed by two side cords linked by pairs of smaller cross strings, between which each slat is inserted, allows the outside ends of said ladder to be pulled, thus achieving excellent closure.

At these ends, the hooks holding the first and last slat have a braking device, which prevents the undesired opening by rotation of the slats of the blind.

BRIEF DESCRIPTION OF THE DRAWINGS

The present invention can be understood better with reference to the accompanying drawings in which:

FIG. 5 shows a perspective view of a head of a slat;

FIG. 6 shows a perspective view of one of the hooks and an end slat; and

FIG. 7 shows a horizontal section view along line 7—7 of FIG. 6.

DETAILED DESCRIPTION OF THE INVENTION

Figure 1:
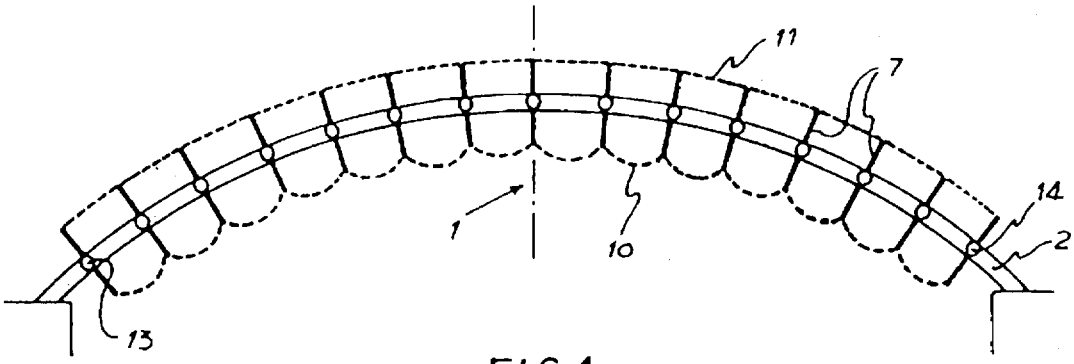
FIG. 1 shows a perspective schematic view from below of a blind according to the invention, fully open and stretched.
Figure 2:
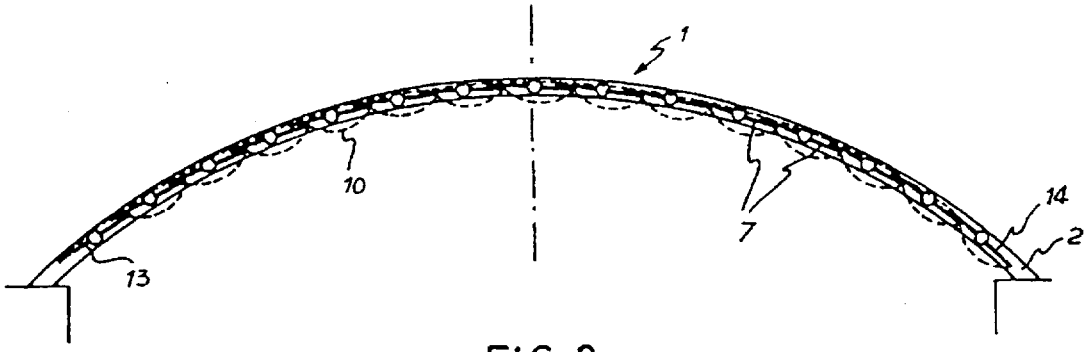
FIG. 2 shows the blind of FIG. 1 in a closed position.

As shown, the new blind 1 has multiple vertical sliding and revolving slats, and includes a headrail 2, which can have several shapes. A flat-sided rectangular section headrail having a central longitudinal groove 3 on its lower front side is shown, which can be manufactured from metal alloys or plastic materials. The headrail can have other shapes, for example, a vertical strip complete with a lower head, to which the hooks are attached, and upper fastening devices for mounting. In said headrail 2, along the longitudinal groove 3, several hooks 4 are placed, which have a head 5 and a hooked part 6, which is inserted into the vertical slats 7, through a pleat 8 at the top end, as illustrated in FIGS. 5 and 6.

Inside the pleated part 8 are housed the cross strings 9 which, together with the outside cords 10 and 11, make up the ladder that adjusts and keeps each slat as far apart as possible from the adjacent slats. If necessary, the bottom ends of the slats could also be linked by another ladder. The bottom ends could also carry a weight so as to maintain their vertical position. In cases in which the material of the slat 7 is not sufficiently stiff to permit it to form a head, into which the hook 6 can be attached through the openings 12, a small cross bar (not shown) could be placed so as to provide the required stiffness.

To open the blind to its sides, to the hooks 4 can have suspended therefrom position wands 15 that would allow the slats to be moved so they could all be folded at one end, or opened by spreading them all along the headrail, by opening the hooks 4 linked by the side cords 10 and 11 of the ladder, which control the horizontal spacing. Turning or rotating the position wands 15 causes the hook 4 to turn or rotate. This pulls the pleat and moves the outside cord 10 to one side, and the other outside cord 11 to the other side.

Figure 3:
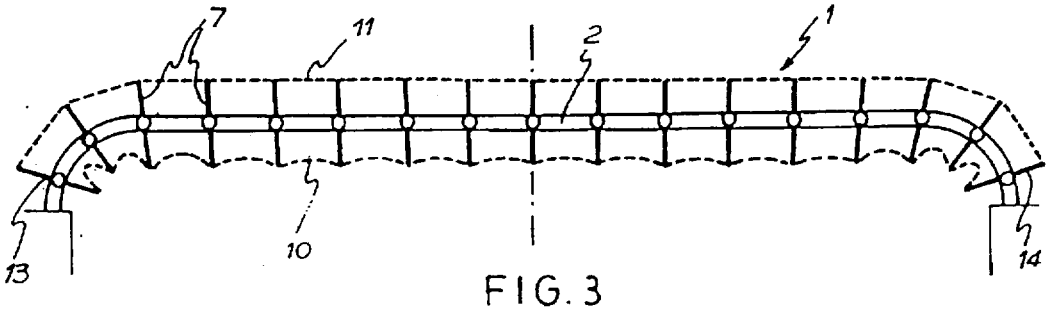
FIG. 3 shows an additional blind having a straight center section with two curved segments at both ends.
Figure 4:
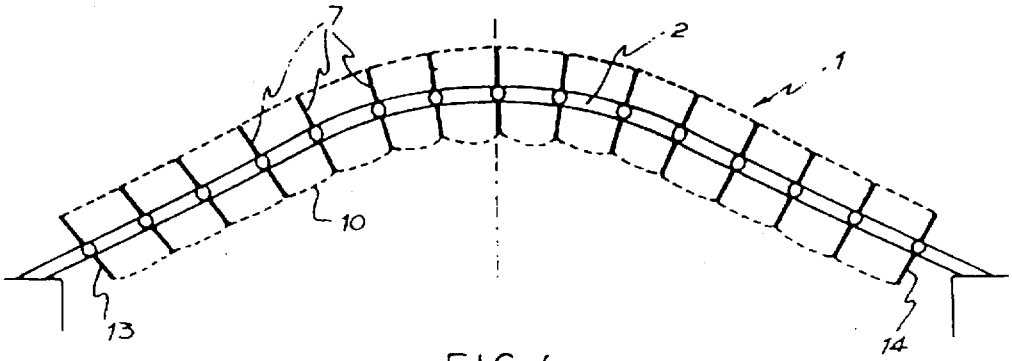
FIG. 4 shows yet another blind having a curved center section between two straight lateral segments.

However, as mentioned above, the headrail 2 has at least one part that is curved, as shown in FIG. 4: either its end sections are curved (FIG. 3),or the whole headrail is curved slightly (see FIG. 1). In this way, the distance to which the outside cord 11 of the ladder must extend is longer than the distance to which the inside cord 10 extends, because of the height of the arch caused by the curvature of the headrail. In this manner, the outside cord 11 may be subjected to a higher stress by using the position wands 15, than the inside cord 10, which remains slack. When pulling the cord 11, the hooks 4 make a complete turn, so that the slats 7 lean against the adjacent slats, thus achieving an excellent closure of the blind.

In pulling the outside cord 11 of a blind, the hooks at both ends 13 and 14 must have a braking device to prevent their counter-rotation due to the tension, to which they are subjected. This brake could be of any kind and, very conveniently, it could be a friction brake, such as the one illustrated in FIG. 7. Such brake is formed by an eccentric head which is supported by and rubs against lateral sides of the headrail 2 when it is in a position of maximum rotation.

It is also clear that, by arranging various curved sections at opposite or different sides, various effects can be obtained with the blind.

I claim:

1. A vertical multiple slat blind comprising:

an elongated headrail having a central slot opening along its length;

a plurality of vertical slats each having a first end with a cross-member extending across the width of the slat;

a plurality of hook member having a head end riding in the slot of said headrail and a hook end, the hook end of a hook member connecting to said first end of a slat;

a first cord and a second cord each connected to one end of said cross-member of each of said plurality of slats for rotating said slats in a first or a second direction as a selected one of said first and second cords is pulled, said headrail having a curved portion such that the one of said first and second cords corresponding to the larger radius of curvature of said headrail has a greater travel distance upon rotation of said slats to effect their closing.

2. The blind of claim 1 wherein said headrail has its two curved ends joined by a straight section.

3. The blind of claim 1 wherein said headrail is continuously curved from one end to the other.

4. The blind of claim 3 wherein the radius of curvature of said headrail is constant.

5. The blind of claim 3 wherein the radius of curvature of said headrail varies.

6. A blind as in claim 1 further comprising a friction type braking device for retarding rotational movement of a said slat.

7. A blind as in claim 6 wherein said friction type braking device comprises a member on a said hook member that engages the interior of said headrail.

8. A blind as in claim 6 wherein said braking device comprises said head of a said hook member which head has an eccentric shape to engage the interior of said headrail as the said slat is rotated.

9. A blind as in claim 1 further comprising a wand connected to one of said hook members to rotate said one hook member and thereby rotate the other said slats through the action of said cords.

* * * * *